US006189320B1

(12) United States Patent
Poeschl et al.

(10) Patent No.: US 6,189,320 B1
(45) Date of Patent: Feb. 20, 2001

(54) BURNER FOR FLUIDIC FUELS HAVING MULTIPLE GROUPS OF VORTEX GENERATING ELEMENTS

(75) Inventors: Gerwig Poeschl, Düsseldorf; Stefan Hoffmann, Mülheim an der Ruhr; Ingo Ganzmann, Erlangen, all of (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/336,943

(22) Filed: Jun. 21, 1999

Related U.S. Application Data

(63) Continuation of application No. PCT/DE97/02858, filed on Dec. 8, 1997.

(30) Foreign Application Priority Data

Dec. 20, 1996 (EP) ..... 196 53 473
Dec. 20, 1996 (EP) ..... 196 53 474

(51) Int. Cl.[7] ..... F23D 14/62; B01F 5/06; F23R 3/12

(52) U.S. Cl. ..... 60/737; 60/748; 431/9; 431/284; 239/400

(58) Field of Search ..... 60/737, 748; 239/400, 239/402, 404, 419.3, 424.5; 431/9, 284

(56) References Cited

U.S. PATENT DOCUMENTS

Re. 33,896 * 4/1992 Maghon et al. ..... 431/284
3,570,242 * 3/1971 Leonardi et al. ..... 60/737
3,796,536 * 3/1974 Hori et al. ..... 431/1
3,938,324 * 2/1976 Hammond, Jr. et al. ..... 60/737
5,016,443 * 5/1991 Shimizu et al. ..... 60/737
5,062,792 * 11/1991 Maghon ..... 431/284

FOREIGN PATENT DOCUMENTS 42 12 810 A1 10/1992 (DE) .
41 23 161 A1 1/1993 (DE) .
44 15 916 A1 11/1995 (DE) .
0 561 591 A2 9/1993 (EP) .
0 619 134 A1 10/1994 (EP) .
0 672 865 A2 9/1995 (EP) .

OTHER PUBLICATIONS

International Patent Application WO 95/26226 (Hüttenhofer et al.), dated Oct. 5, 1995.

* cited by examiner

*Primary Examiner*—Ted Kim
(74) *Attorney, Agent, or Firm*—Herbert L. Lerner; Laurence A. Greenberg; Werner H. Stemer

(57) ABSTRACT

A burner, in particular for a gas turbine, in which combustion air is subjected to a vorticity by a vortex element, admits fuel to the vortical combustion air. At the same time, a pressure loss produced by the vortex element is small. A low $NO_x$ emission at virtually the same efficiency is achieved.

18 Claims, 2 Drawing Sheets

BURNER FOR FLUIDIC FUELS HAVING MULTIPLE GROUPS OF VORTEX GENERATING ELEMENTS

CROSS-REFERENCE TO RELATED APPLICATION

This application is a continuation of copending International Application No. PCT/DE97/02858, filed Dec. 8, 1997, which designated the United States.

BACKGROUND OF THE INVENTION

Field of the Invention

The invention relates to a burner for fluidic fuels, in particular for use in a gas-turbine plant.

A burner for fluidic fuels, which is used in particular in a gas-turbine plant, has been disclosed by German Published, Non-Prosecuted Patent Application DE 42 12 810 A1. It is apparent from that publication that air is fed through an annular air-feed-duct system and fuel is fed through a further annular-duct system to the combustion. In that case, fuel is injected from the fuel duct into the air duct, either directly or from swirl blades constructed as hollow blades.

The intention is thus to achieve, inter alia, a homogeneous mixing of fuel and air as far as possible in order to achieve combustion having a low concentration of nitrous oxides. It is an essential requirement for combustion, in particular for combustion in the gas-turbine plant of a power station, to achieve as low a production of nitrous oxides as possible, for reasons of environmental protection and corresponding statutory guidelines for pollutant emissions. The formation of nitrous oxides increases exponentially with the flame temperature of the combustion. If there is inhomogeneous mixing of fuel and air, a certain distribution of the flame temperatures in the combustion region results. In accordance with that exponential connection between nitrous-oxide formation and flame temperature, the quantity of nitrous oxides being formed is substantially determined by the maximum temperatures of such a distribution. Accordingly, the combustion of a homogeneous fuel/air mixture, at the same average flame temperature, achieves a lower nitrous-oxide discharge than the combustion of an inhomogenous mixture. In the case of the burner structure of the publication cited, spatially effective mixing of air and fuel is achieved.

European Patent Application 0 561 591 A2 discloses a rotation cascade for generating a turbulent flow for use in a burner, in particular in a premix burner of a gas turbine. The rotation cascade serves to generate two concentric, contra-rotating flows so that, during partial-load operation of the gas-turbine plant, a reduced fuel quantity is burned in an inner flow in an air quantity reduced by splitting up into two flows and thus stable combustion can also be maintained during partial-load operation. Furthermore, the rotation cascade generates backflow zones which directly adjoin the rotation cascade and constitute combustion zones for stable combustion.

European Patent Application 0 619 134 A1 discloses a mixing chamber for mixing substances, e.g. in chemistry and in the production of foodstuffs or pharmaceuticals. The substances to be mixed are subjected to vorticity in separate ducts by a vortex generator and then brought together. The vortex generator is formed by deflecting elements constructed as elongated half pyramids.

A method and a device for the combustion of a free-flowing fuel, in particular in the burner of a gas turbine, are described in German Published, Non-Prosecuted Patent Application DE 44 15 916 A1. A turbulence-generating configuration is inserted in the air duct of the burner, so that combustion air is subjected to vorticity. Fuel is admitted to the vortical combustion air, so that an especially effective intermixing of fuel and combustion air is obtained. The vorticity is achieved by a number of obtuse flow obstacles, in particular by rods or discs. German Published, Non-Prosecuted Patent Application DE 41 23 161 A1 discloses a vortex element designated as a static mixer. It has a multiplicity of deflecting elements, which are small relative to the diameter of a pipe line or a flow duct in which it can be inserted and are inclined relative to the axis of the flow duct or the pipe line. The inclination of the deflecting elements, which are lined up in rows, is in the same direction within a row and in opposite directions from row to row. Such a vortex element covers a single cohesive area, e.g. a circular or rectangular cross section. It serves to subject a flow of a medium through the pipe line or the flow duct to vorticity, as a result of which effective intermixing with a substance fed into the medium can be achieved. Comparable, large vortex elements are also described in European Patent 0 634 207 B1 and in International Publication No. WO 95/26226 A1. The main field of application of such vortex elements is the nitrous-oxide reduction of flue gas by the admixing of ammonia in flow ducts having a cross-sectional area of typically a few square meters.

SUMMARY OF THE INVENTION

It is accordingly an object of the invention to provide a burner for fluidic fuels, which overcomes the hereinafore-mentioned disadvantages of the heretofore-known devices of this general type and which permits effective mixing of combustion air and fuel while at the same time other parameters of the combustion are only slightly affected.

With the foregoing and other objects in view there is provided, in accordance with the invention, a burner for fluidic fuels, in particular for use in a gas-turbine plant, comprising an air duct for feeding combustion air; a fuel duct for feeding fuel; an inlet for conducting fuel from the fuel duct into the air duct; and a vortex element upstream of the inlet for generating high turbulence in the combustion air, the vortex element including a first boundary ring having an axis of symmetry, a second boundary ring larger than the first boundary ring, the second boundary ring having a center on the axis of symmetry, a connecting area defined or spread out by the boundary rings, and a multiplicity of flat deflecting elements disposed along circles lying on the connecting area, each of the deflecting elements having a respective center lying on the axis of symmetry and each of the deflecting elements inclined relative to a normal to the connecting area.

A burner having such a vortex element has an especially small pressure lose caused by the vortex element. In addition, the vortex element is suitable for use in an annular flow duct. At least two and preferably three circles are provided.

The advantages of such a vortex element are obtained in particular when used for subjecting combustion air to vorticity in a burner, in accordance with the explanations given herein.

In accordance with another feature of the invention, the pressure loss produced by the vortex element is less than 2%.

An essential advantage of the invention lies in the fact that especially effective mixing of combustion air and fuel can be achieved by the turbulent flow of the combustion air, while at the same time a pressure loss caused by the vortex element is slight. Improved spatial homogeneity of the mixture is achieved by the mixing of fuel and combustion air in the turbulent flow. In addition, the variation in the mixture ratio with time has been determined in extensive tests for the first time. Locally occurring variations in the mixture ratio with time, as well as the spatial inhomogeneity, lead to a distribution of the flame temperature having the adverse effects on the nitrous-oxide emission which are explained above. The results of the tests showed that the fuel/air mixture produced exhibits a slight variation in ratio with time. Thus mixing of fuel and air which is largely homogeneous spatially and with time and thus reduced nitrous-oxide production are achieved. The pressure loss, which at the same time is only slight, leaves the efficiency of the burner virtually unaffected. This constitutes a considerable improvement over previously used vortex elements which were constructed as obtuse flow obstacles. Such flow obstacles result in a considerable pressure loss, so that improved mixing of fuel and combustion air had to be paid for with a markedly reduced efficiency of the burner.

In order to avoid flame stabilization at the vortex element, the fuel is admitted on the downstream side of the vortex element. Thus only combustion air flows through the vortex element, and the risk of combustion in the region of the vortex element, which could damage the latter, is reduced.

In accordance with a further feature of the invention, the vortex element is constructed in such a way that the turbulent flow of combustion air which can be generated at the vortex element has essentially no zones of backflowing combustion air. Thus a situation is achieved in which no ignitable fuel/air mixture can flow back to the vortex element and thus combustion, which could damage the vortex element, is not stabilized at the latter.

In accordance with an added feature of the invention, the turbulent flow of combustion air which can be generated has vortices of a diameter comparable to the width of the air duct, in particular a diameter of 20–80% of the width of the air duct. This configuration achieves a situation in which the region of the fuel inlet can be completely covered by a vortex and the turbulent flow extends beyond the region of the fuel inlet, so that mixing is effected both in the vortex at the fuel inlet and in the turbulent flow behind the fuel inlet, with the effect of especially intensive intermixing.

In accordance with an additional feature of the invention, there are provided swirl blades disposed in the air duct on the downstream side of the vortex element. In this way, a vortex element having the advantageous effects described above on the homogeneity of the mixing of fuel and combustion air is used in combination with swirl blades, which have a favorable effect on the stability of the combustion.

In accordance with yet another feature of the invention, at least one of the swirl blades is constructed as a hollow blade from which the fuel can be admitted. It is possible with this configuration to utilize a uniform injection of fuel from a swirl blade, constructed as a hollow blade and having a further homogenizing effect on the fuel/air mixture, in combination with the advantages explained above.

In accordance with yet a further feature of the invention, the burner is constructed as a premix or hybrid burner for use in gas-turbine plants, having an air feed duct, in particular a narrowing annular duct, which encloses at least three further annular ducts disposed in particular concentrically to the air-feed duct and intended for feeding fluidic media, two of the further ducts serving to supply a pilot burner, and a pilot flame for maintaining the combustion being able to be produced by the pilot burner.

In accordance with yet an added feature of the invention, the connecting area is less than half the circular area enclosed by the larger second boundary ring.

In accordance with yet an additional feature of the invention, the diameter of the larger boundary ring is also less than one meter, preferably 40 cm, to 60 cm. The vortex element is thus suitable for use in small flow ducts, such as, for example, air ducts of gas-turbine burners.

In accordance with again another feature of the invention, the deflecting elements which are allocated to one circle are at an equal distance from one another. Thus uniform vorticity is achieved over the entire connecting area.

In accordance with again a further feature of the invention, each deflecting element narrows from the connecting area to a separation edge for generating vortices. It preferably has an approximately trapezoidal or triangular shape. Especially intensive vorticity is achieved with this configuration.

In accordance with again an added feature of the invention, the deflecting elements which are allocated to a respective circle are inclined in the same direction.

In accordance with a concomitant feature of the invention, the deflecting elements disposed on circles which are adjacent one another are inclined in opposite directions. This configuration of the deflecting elements, in addition to producing the locally effective intermixing by the vorticity, results in homogenization over larger regions of the flow.

A method of operating a burner for fluidic fuels, in particular for use in a gas-turbine plant, includes feeding combustion air in an air duct and fuel in a fuel duct to the combustion, the combustion air in the air duct is subjected to vorticity by transforming it into a highly turbulent flow having a pressure loss of less than 5%, in particular less than 2%, and subsequently fuel from the fuel duct is admitted to the vortical combustion air, so that a vortical fuel/air mixture results.

This mixture is especially homogeneous due to the vorticity, a factor which, according to the introductory statements and the explanations of the advantages of the invention concerning the burner, results in combustion having a low concentration of nitrous oxides. Due to the slight pressure loss, the efficiency of the burner is essentially retained.

Other features which are considered as characteristic for the invention are set forth in the appended claims.

Although the invention is illustrated and described herein as embodied in a burner for fluidic fuels, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
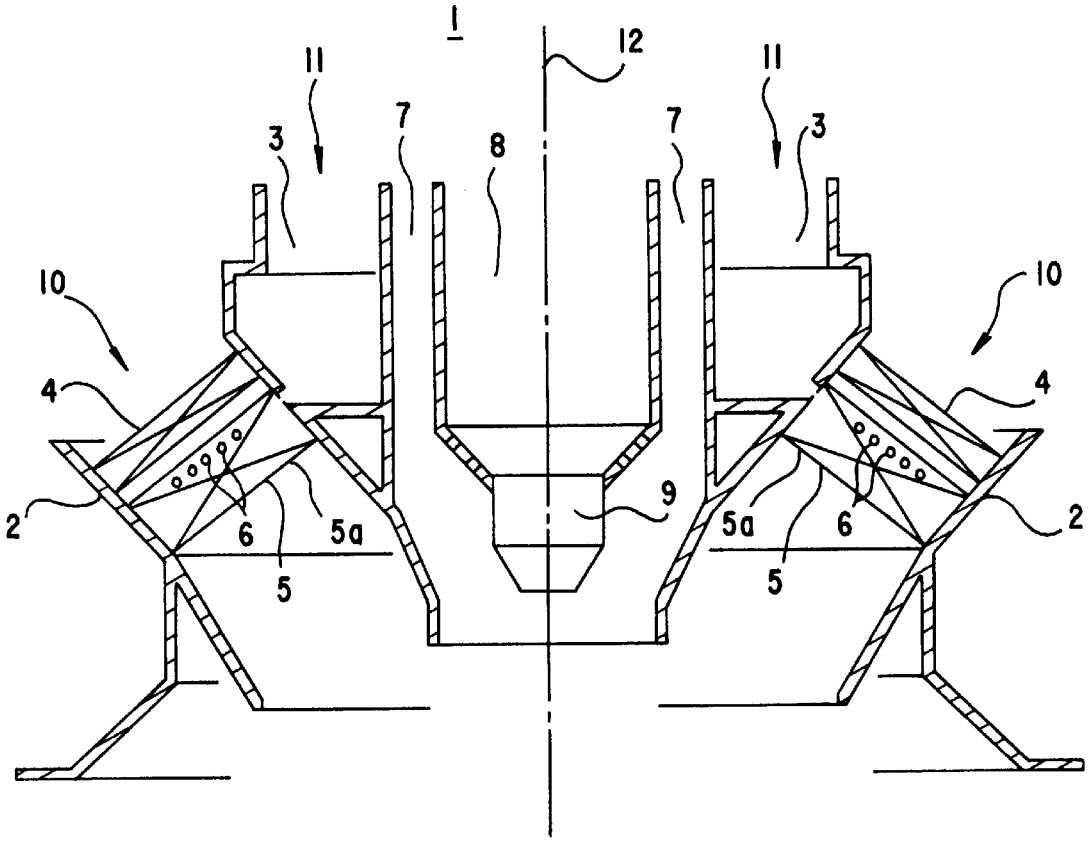
FIG. 1 is a fragmentary, diagrammatic, longitudinal-sectional view of a hybrid burner.

Referring now to the figures of the drawings in detail and first, particularly, to FIG. 1 thereof, there is seen a hybrid burner 1, which is approximately rotationally symmetrical with regard to an axis 12. A pilot burner 9, which is directed along the axis 12 and has a fuel-feed duct 8 and an annular air-feed duct 7 concentrically enclosing the latter, is concentrically surrounded by an annular fuel duct 3. This annular fuel duct 3 is enclosed at the bottom, i.e. partly concentrically, by an annular air-feed duct 2. A swirl blade ring 5, which is shown diagrammatically, is fitted in this annular air-feed duct 2. At least one of these swirl blades 5 is constructed as a hollow blade 5*a*. The hollow blade 5*a* has an inlet 6 which is formed by a plurality of openings and is intended for a fuel feed. The annular fuel duct 3 leads into this hollow blade 5*a*. A diagrammatically illustrated vortex element 4 is fitted in the air duct 2 on the inflow side of the swirl-blade ring 5.

The hybrid burner 1 may be operated as a diffusion burner through the pilot burner 9. Normally, however, it is used as a premix burner, that is fuel and air are first mixed and then fed to the combustion. In the process, the pilot burner 9 serves to maintain a pilot flame, which stabilizes the combustion during the premix-burner operation if there is a possibly varying fuel/air ratio. For the actual combustion, combustion air 10 and fuel 11 are mixed in the air duct 2 and subsequently fed to the combustion. In the case of the illustrated exemplary embodiment, the fuel 11 is directed from the fuel duct 3 into a hollow blade 5*a* of the swirl-blade ring 5 and is directed from there through the inlet 6 into the combustion air 10 in the air duct 2.

As was already mentioned, combustion having a low concentration of nitrous oxides substantially depends on achieving a homogenous mixing of combustion air 10 and fuel 11 as far as possible. This is achieved by the vortex element 4, which transforms the combustion air 10 into a turbulent flow. The fuel 11 which is fed into the turbulent combustion air 10 is mixed especially effectively with the combustion air 10 by the vorticity.

Homogenous mixing of combustion air 10 and fuel 11 in a spatial manner and with respect to time is achieved. At the same time, the pressure loss caused by the vortex element 4 is slight, as a result of which the efficiency of the burner 1 is scarcely affected.

Figure 3:
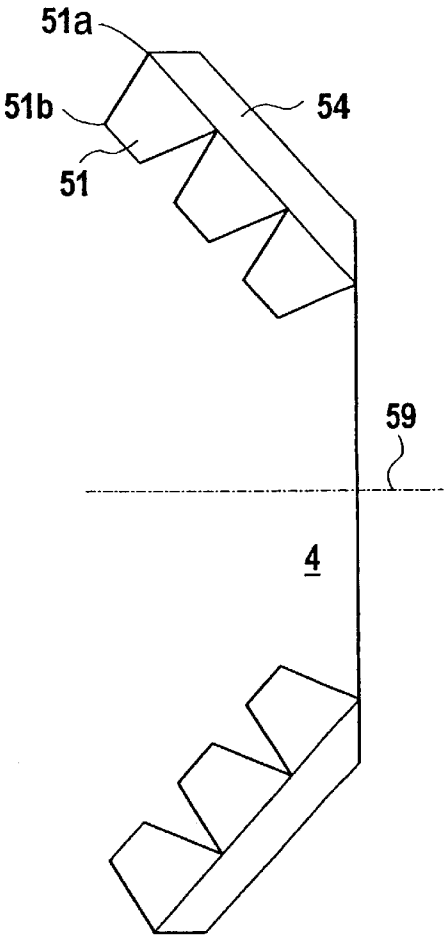
FIG. 3 is a side-elevational view of a vortex element.
Figure 2:
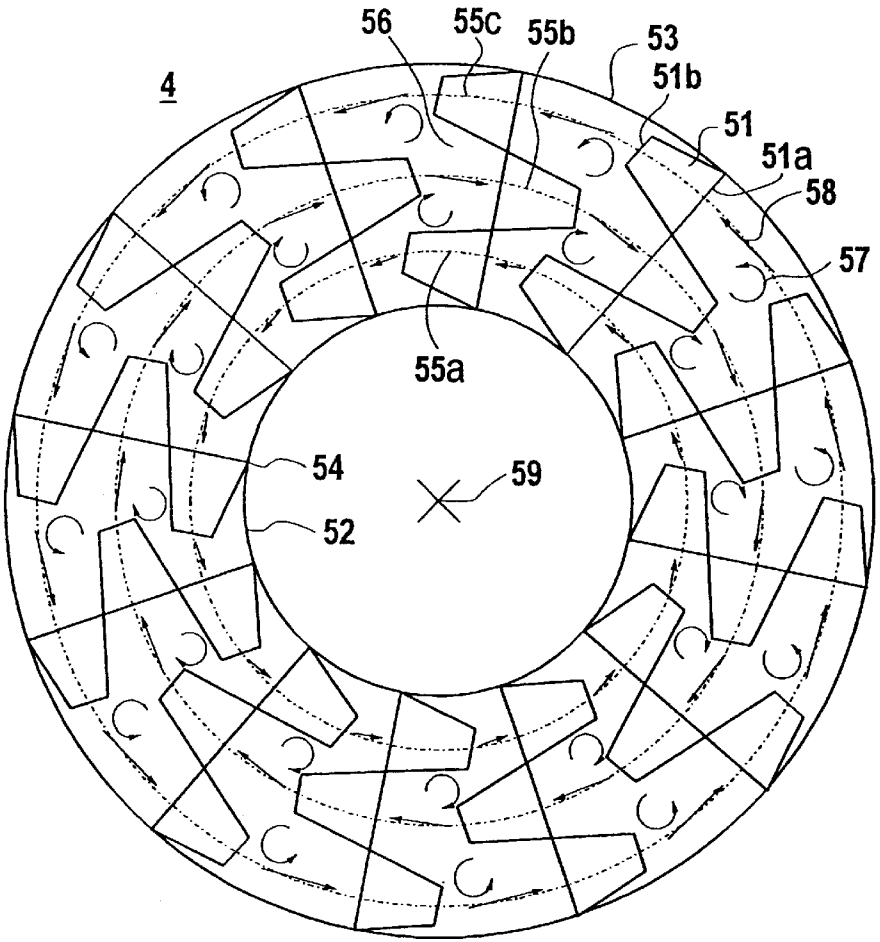
FIG. 2 is a plan view of a vortex element.

FIG. 2 shows a plan view of a vortex element 4. FIG. 3 uses the same reference numerals to show the same vortex element 4 in a side view. A multiplicity of webs 54 lead from an inner boundary ring 52 to an outer boundary ring 53 in such a way as to be distributed uniformly over the ring periphery. A center of the outer boundary ring 53 lies on an axis of symmetry 59 of the inner boundary ring 52, and the webs 54 are directed normal to the inner boundary ring 52. A connecting area 56 represents a generated surface of a truncated cone between the inner boundary ring 52 and the outer boundary ring 53. Trapezoidal, flat deflecting elements 51 which point into the interior of the truncated cone are disposed on each web 54. A wide side 51*a* of each deflecting element 51 is connected to a web 54. The deflecting elements 51 are disposed at equal distances from one another along three circles 55*a*, 55*b*, 55*c* that are concentric to the axis of symmetry 59. The deflecting elements 51 are inclined relative to a normal of the connecting area 56. In each case, the deflecting elements 51 are inclined in the same direction along a circle 55*a*, 55*b*, 55*c* and in opposite directions from one circle 55*a*, 55*b*, 55*c* to an adjacent circle 55*a*, 55*b*, 55*c*.

A flow of combustion air 10 through the vortex element 4 normal to the connecting area 56 into the interior of the truncated cone results in vortices 57 being formed at narrow sides or separation edges 51*b* of the deflecting elements 51. Fuel 11 directed into the flowing medium is intensively mixed with the combustion air 10 by this vorticity. In addition, the inclination of the deflecting elements 51 imposes secondary flows 58 on the main flow. In addition to the locally effective intermixing of the vorticity, the secondary flows permit homogenization of the mixture over the entire cross-sectional area of an annular air-feed duct in which the vortex element is fitted according to FIG. 1. At the same time, due to the configuration of the vortex element 4, the pressure loss caused by the vorticity is slight.

We claim:

1. A burner for fluidic fuels, comprising:

an air duct for feeding combustion air;

a fuel duct for feeding fuel; an inlet for conducting fuel from said fuel duct into said air duct; and a vortex element upstream of said inlet for generating high turbulence in the combustion air, said vortex element including:

a) a first boundary ring having an axis of symmetry;

b) a second boundary ring larger than said first boundary ring, said second boundary ring having a center on said axis of symmetry;

c) a connecting area defined by said boundary rings; and d) a multiplicity of flat deflecting elements disposed in groups along circles lying on said connecting area, each of said groups of deflecting elements having a respective center lying on said axis of symmetry and each of said deflecting elements inclined relative to a normal to said connecting area; and swirl blades disposed in said air duct downstream of said vortex element.

2. The burner according to claim 1, wherein said vortex element causes a pressure loss of less than 2%.

3. The burner according to claim 1, wherein said vortex element causes a turbulent flow of the combustion air to be generated at said vortex element to have vortices with a diameter comparable to a width of said air duct.

4. The burner according to claim 3, wherein said vortices have a diameter of 20% to 80% of the width of said air duct.

5. The burner according to claim 1, wherein at least one of said swirl blades is a hollow blade from which the fuel can be admitted.

6. The burner according to claim 1, including a pilot burner for producing a pilot flame to maintain combustion, and at least three further annular ducts enclosed by said air duct and feeding fluidic media, two of said further annular ducts supplying said pilot burner.

7. The burner according to claim 6, wherein said air duct is a narrowing annular duct, and said at least three further annular ducts are disposed concentrically to said air duct.

8. The burner according to claim 1, wherein said connecting area of said vortex element is less than half of a circular area enclosed by said second boundary ring.

9. The burner according to claim 1, wherein said second boundary ring of said vortex element has a diameter of less than one meter.

10. The burner according to claim 1, wherein said second boundary ring of said vortex element has a diameter of 40 cm to 60 cm.

11. The burner according to claim 1, wherein said deflecting elements of said vortex element allocated to one of said circles are equidistant from one another.

12. The burner according to claim 1, wherein each of said deflecting elements of said vortex element narrows from said connecting area to a separation edge for generating vortices.

13. The burner according to claim 12 wherein said deflecting elements have an approximately trapezoidal shape.

14. The burner according to claim 1, wherein said deflecting elements of said vortex element allocated to one of said circles are inclined in the same direction.

15. The burner according to claim 14, wherein said deflecting elements disposed on mutually adjacent circles of said vortex element are inclined in opposite directions.

16. A burner for fluidic fuels in a gas-turbine plant, comprising:

an air duct for feeding combustion air;

a fuel duct for feeding fuel;

an inlet for conducting fuel from said fuel duct into said air duct; and a vortex element upstream of said inlet for generating high turbulence in the combustion air, said vortex element including:

a) a first boundary ring having an axis of symmetry;

b) a second boundary ring larger than said first boundary ring, said second boundary ring having a center on said axis of symmetry;

c) a connecting area defined by said boundary rings; and d) a multiplicity of flat deflecting elements disposed in groups along circles lying on said connecting area, each of said groups of deflecting elements having a respective center lying on said axis of symmetry and each of said deflecting elements inclined relative to a normal to said connecting area; and swirl blades disposed in said air duct downstream of said vortex element.

17. A premix or hybrid burner for fluidic fuels in a gas-turbine plant, comprising:

an air duct for feeding combustion air;

a fuel duct for feeding fuel;

an inlet for conducting fuel from said fuel duct into said air duct;

a vortex element upstream of said inlet for generating high turbulence in the combustion air, said vortex element including:

a) a first boundary ring having an axis of symmetry;

b) a second boundary ring larger than said first boundary ring, said second boundary ring having a center on said axis of symmetry;

c) a connecting area defined by said boundary rings; and d) a multiplicity of flat deflecting elements disposed in groups along circles lying on said connecting area, each of said groups of deflecting elements having a respective center lying on said axis of symmetry and each of said deflecting elements inclined relative to a normal to said connecting area; a pilot burner for producing a pilot flame to maintain combustion; and at least three further annular ducts enclosed by said air duct and feeding fluidic media, two of said further annular ducts supplying said pilot burner.

18. The premix or hybrid burner according to claim 17, wherein said air duct is a narrowing annular duct, and said at least three further annular ducts are disposed concentrically to said air duct.

* * * * *